United States Patent [19]

Allaire, Jr.

[11] Patent Number: 4,461,048

[45] Date of Patent: Jul. 24, 1984

[54] UNIVERSAL BED COVERING OR BED SHEET APPARATUS

[76] Inventor: Ralph M. Allaire, Jr., 28 Caldwell Dr., Princeton, N.J. 08540

[21] Appl. No.: 376,404

[22] Filed: May 10, 1982

[51] Int. Cl.[3] ..... A47G 9/02

[52] U.S. Cl. ..... 5/497; 5/493

[58] Field of Search ..... 5/495, 497, 498, 496, 5/499, 484, 485, 487, 482

[56] References Cited

U.S. PATENT DOCUMENTS

| | | | |
|---|---|---|---|
| 738,674 | 9/1903 | Grattan | 5/496 |
| 3,144,666 | 8/1964 | Mazera et al. | 5/497 |
| 4,045,831 | 4/1977 | Clark | 5/497 |
| 4,144,602 | 3/1979 | Fernandes | 5/496 |
| 4,279,045 | 7/1981 | Vitale | 5/497 |

FOREIGN PATENT DOCUMENTS

| | | | |
|---|---|---|---|
| 728617 | 12/1966 | Italy | 5/496 |

*Primary Examiner*—Alexander Grosz

*Attorney, Agent, or Firm*—Arthur L. Plevy

[57] ABSTRACT

A bed covering or sheet is described which is made from an integral piece of material and which consists of a central rectangular area bounded on each side by a rectangular panel of a width equal to the thickness of the mattress. Further depending from the longer side panels is a trapezoidal panel. The sheet as fabricated is sewn at each corner in a unique manner to form a structure which can serve as both a top fitted sheet and a bottom fitted sheet. To further enhance the aesthetic qualities of the product, a piping or trim is sewn at appropriate edges to create a fashionable appearance to both the top and bottom sheets.

9 Claims, 4 Drawing Figures

UNIVERSAL BED COVERING OR BED SHEET APPARATUS

BACKGROUND OF THE INVENTION

This invention relates to an improved bed covering or a sheet or similar article which can be used as both a top and a bottom fitted sheet and more particularly to a universal sheet whereby the same sheet can be employed as both a top fitted sheet and a bottom fitted sheet.

In regard to the sheet industry it is sufficient to say that since the custom fitted sheet little progress has been made in developing a new product. In present practice many institutions such as motels, hotels, hospitals, as well as consumers use a custom fitted sheet as a bottom sheet. The custom fitted sheet is very well-known and is used to cover the mattress. Such sheets usually have an elastic strip at each corner or a single continuous strip which surrounds the open edge of the sheet. The term custom is employed as these sheets fit over a mattress and are held in position by the elastic and by the nature and form of the sheet as fabricated. Apart from the apparent problems regarding the elastic which results in the breaking or stretching of the elastic during laundering or during use, such sheets are difficult to fold and are relatively bulky when folded and hence take up a great deal of storage room.

In present practice there is also used a top sheet. The top sheet is used beneath the blanket and is a flat sheet. In this manner, the flat sheet serves as a barrier to prevent the person occupying a bed to come into contact with the blanket. This flat sheet is also available and is widely used in the industry.

As is apparent from the above, the sheet manufacturer, as well as his customers such as department stores or other sales outlets, are required to stock two different types of sheets for use as bed coverings. In any event, this has created a great problem in regard to the department stores or in regard to various retail outlets. Accordingly, such facilities have to stock both flat and custom sheets and these sheets may be of various colors and patterns. Hence, there is a continuous stock problem and inventory problem in storing two different types of sheets. It is of course also understood that the custom sheet is more bulky than a flat sheet and hence this takes up more storage space.

In any event, the prior art was cognizant of this problem and there exists certain patents which attempt to formulate a single sheet which can be used as both a top and a bottom fitted sheet. An example of such structure is shown in U.S. Pat. No. 4,045,831 issued on Sept. 6, 1977 to W. F. Clark. This Patent shows a bed sheet which can be used both as a bottom and top sheet. The bed sheet has a fabric panel which is sized to fit the mattress and has open pockets at each end of the bed sheet which serve to enclose the head and foot portions of the mattress when used as a bottom sheet. When used as a top sheet, one pocket is used to enclose the foot portion of the mattress while the second pocket is used to hold the edge of a blanket from contact with a person while sleeping.

In any event, this sheet and other sheets have not been accepted in the industry due to many considerations. A major desire is the use of a sheet which is simple to use to enable a person to make the bed in a quick and reliable manner. Hence a major objective in formulating a universal sheet is to provide a structure which can easily be accomodated and used in a rapid and reliable manner. It is of course extremely important to provide a sheet which is easy to manufacture and which requires less material while completely avoiding the use of any elastic. Such a sheet should also be capable of flat folding so that it will occupy a minimum of storage space. In any event, a major advantage of a universal sheet is to enable the reduction of inventory whereby a retail facility need only store one sheet configuration which configuration can be employed as both a top and a bottom fitted sheet.

It is of course understood that apart from all the above considerations one must provide a sheet which has aesthetic value and hence serves as an attractive bed covering while further giving the consumer, the retailer and the manufacturer a most economical and efficient structure.

BRIEF DESCRIPTION OF THE PREFERRED EMBODIMENT

An improved bed covering or sheet which can be employed as both a top or bottom sheet for a bed mattress, comprises a fabric box-like structure having an opened bottom surface and a closed planar top surface which is substantially the same length and width as said mattress, with two opposite sidewalls of said box-like structure having a width substantially equal to the thickness of said mattress, with the other two sidewalls having a first portion of the same width as the thickness of said mattress and with a further trapezoidal portion depending therefrom, with the base of said trapezoidal portion integral with the outer edge of said associated first portion.

DETAILED DESCRIPTION OF THE INVENTION

Figure 1:
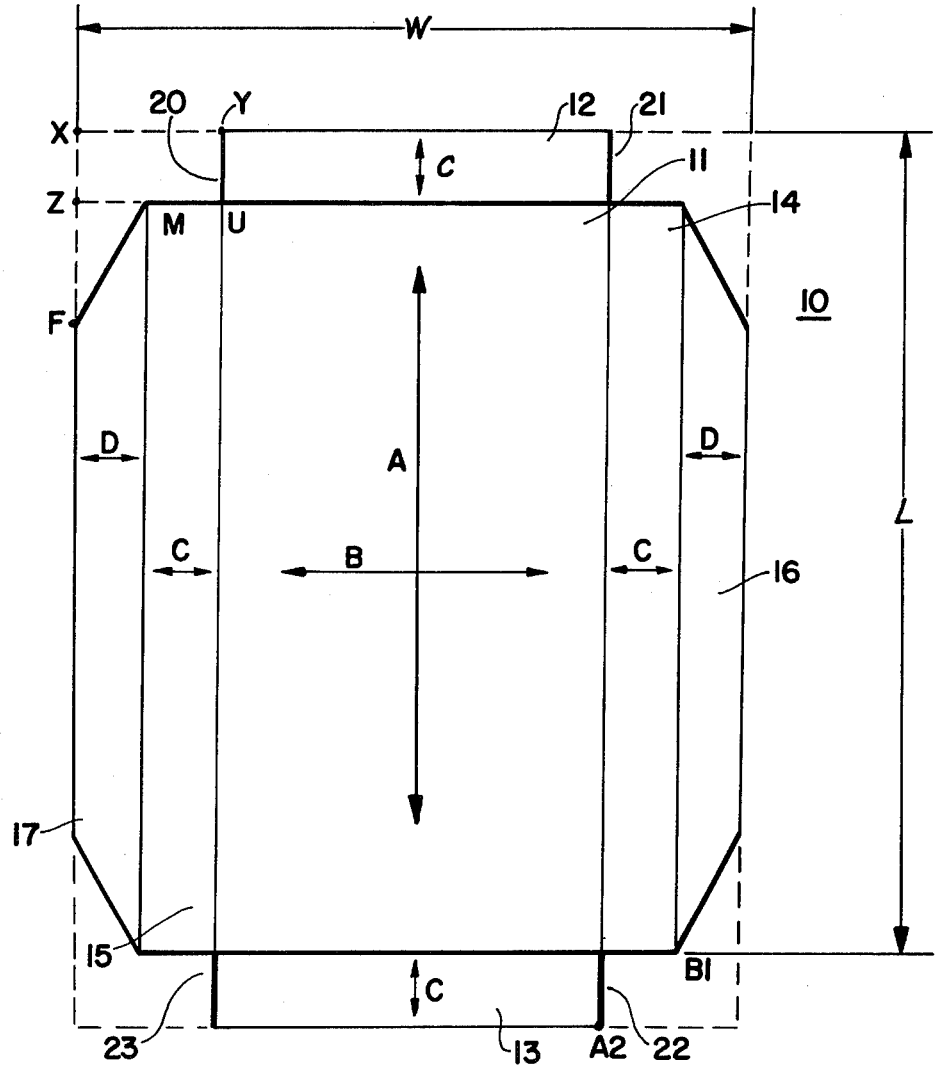
FIG. 1 is a top plan view of a blank or pattern which is used to fabricate a sheet according to this invention.

Referring to FIG. 1, there is shown a blank 10 which blank, as will be explained, is cut according to the pattern shown and sewn to form the universal sheet of this invention. The blank or sheet 10 can be made from any of the conventional materials now employed in the fabrication of bed sheets or bed coverings in general. Thus, one can employ any of the synthetic materials, as well as cotton, muslin, linen or various combinations of the same.

As seen from FIG. 1, the blank 10 consists of a central panel 11 having a length A which is relatively equal to the length of a conventional mattress and a width B which is relatively equal to the width of a conventional mattress. For example, it is well-known that mattresses are dimensioned and are manufactured in standard sizes. As such, these dimensions vary very slightly from manufacturer to manufacturer. In regard to such mattresses there is a conventional single mattress, a double mattress, a queen size and a king size. As indicated, these mattresses are of all relatively standard dimensions. Emanating from the top and bottom surfaces of the center panel 11 are panels 12 and 13 designated by letter C. These panels which are integral with the center panel 11 have a width which is relatively equal to the thickness of a conventional mattress. It is also understood that the thickness of conventional mattresses are also relatively standard.

Thus as seen from FIG. 1, the panels 12 and 13 have a length equal to the width of the mattress B and a width which is relatively equal to the thickness of the mattress. Also emanating from the sides of the central panel are two additional rectangular panels 14 and 15. These panels are also designated by the letter C to indicate that they also have a width determined by the thickness of the mattress and have a length equal to the length A of the mattress. Emanating from each side panel 14 and 15 is an associated outer panel 16 and 17. The outer panels 16 and 17 are trapezoidal in shape and are referenced in FIG. 1 by the letter D with the approximate width of each panel being about six inches. It is of course understood that these dimensions are given by way of example only. Other lengths and widths can be employed as well.

FIG. 1, of course shows distinct lines separating each of the panels in order to provide a simple explanation. It is of course understood that the blank 10 as depicted is formed from an integral piece of cloth. Essentially, an appropriate piece of cloth is cut to provide the pattern or blank shown in FIG. 1. As seen, the blank contains four right angled corners such as 20, 21, 22 and 23. Referring to corner 22, the edge B1 and edge A2 are sewn together to form a flat seam. This is done at each corner as 20, 21 and 23.

Figure 2:
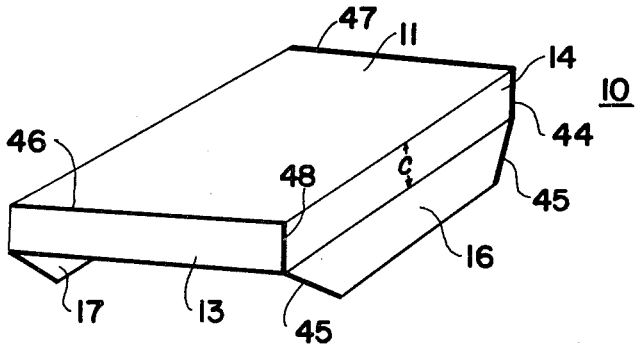
FIG. 2 is a perspective view of a sheet according to this invention.

FIG. 2 shows a perspective view of a sheet according to this invention after the corners have been sewn, as will be described. The various panels, as shown in FIG. 1, are indicated by the same reference numerals in FIG. 2.

As can be seen from FIG. 2, the sheet essentially consits of a box-like structure having a top sheet surface 11 which is a rectangular configuration with sides as 13 and 14 of a thickness equal to the thickness of the mattress to form an open bottom used to cover the mattress and with depending trapezoidal panels as 16 directed downwardly from the longer side panels as 14 and 15.

Thus as one can ascertain, the sheet as depicted in FIG. 2 is merely placed over the mattress when used as a bottom sheet. The panels 16 and 17 may be placed beneath the mattress and the box spring or tucked in, in a conventional manner. Since the corners of the sheet are sewn flat the sheet can easily be folded into a flat configuration and simply stored. When used as a top sheet, the sheet is drawn inside out. In this manner, the sheet can accomodate a blanket in a simple and reliable manner.

Figure 3:
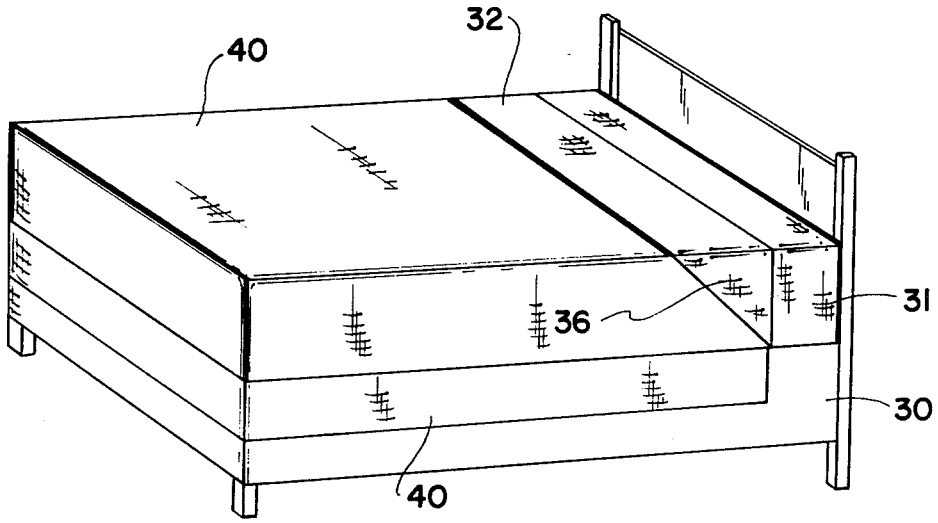
FIG. 3 is a perspective view of a bed employing a top and bottom sheet according to this invention.

Referring to FIG. 3, there is shown a bed 30. The bed 30 is made up with a bottom sheet 31 of the configuration depicted in FIG. 2. An identical top sheet 32 is also depicted in the figure accomodating a blanket. It is seen that the sheet when drawn inside out is of the exact configuration as shown in FIG. 2. The blanket 40 is emplaced over the top sheet which is then folded at the top edge as shown in FIG. 3 to provide an extremely aesthetic fold whch provides an angular side panels 36 at each side.

Figure 4:
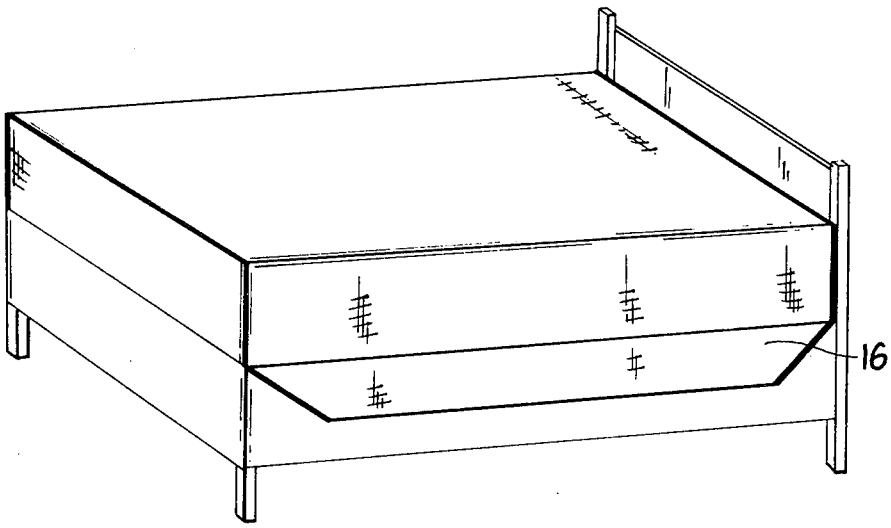
FIG. 4 is a plan view of a bed employing a sheet or bed covering according to this invention.

FIG. 4 depicts the sheet of FIG. 2 emplaced over a mattress on a bed with the trapezoidal panel 16, forming a side drape effect.

Thus it is seen that the single sheet which is formulated from the blank of FIG. 1 can be used as a top and a bottom sheet in a simple and reliable manner. In any event, in order to enhance the beauty of the sheet, a piping or a trim may also be employed about the edges of the sheet as shown in FIG. 2. Thus a piping 45 may be sewn on each of the outer edges of the trapezoidal panel 16, as well as the corresponding panel 15. A further piping may be used at the edges of panels 12 and 11, as well as panels 13 and 11, as shown in FIG. 2, as numerals 46 and 47. The piping is also continued down to each side edge of the sheet as 48 and 49. In this manner, the piping may be of a contrasting color which matches the sheet pattern and therefore creates an extremely pleasing appearance to the entire sheet. Referring to FIG. 3 and FIG. 4, the piping is seen as depicted in heavier lines to show how the piping enhances the beauty of both the top and bottom sheets when employed on a conventional bed.

It is of course understood that the sheet depicted can be manufactured to be accomodated and used with any size mattress now existing. A sheet is capable of easily and simply serving as both a top and bottom sheet and hence eliminates all of the above described problems regarding storage, thus resulting in an economical and universal structure. The placement of a sheet as employed as both a bottom and top sheet is extremely rapid and simple. In order to fully understand the nature of this sheet a simple description will be given on how such a sheet can be manufactured.

Referring to FIG. 1, the dashed lines depict a piece of fabric which is rectangular in shape and may, for example, be 91" in length and 66" in width. The dimensions designated by the letters L & W. It is of course understood that these dimensions are given by way of an example only. Each end is then hemmed with a 2" hem + a $\frac{1}{2}$" turn under. The width of the finished sheet is determined by subtracting 2" from the mattress width. For example, if a twin mattress is 39" wide the sheet would be 37". The sheet width which is 37" is subtracted from the fabric width which is 66". This gives 29" which when divided in half equals to 14.5". This amount is measured from each edge such as edge X to point Y on the fabric and marked. The depth of the mattress or thickness designated by C is then marked from point X and point Y. The rectangle XYZU is then cut. From point U a distance of $6\frac{1}{2}$" is measured to obtain point M. This point is marked. The point F, which is the apex of the side of the trapezoid is obtained by measuring 10" from point Z and the triangle FMZ is then cut. This is done for each corner.

It is of course understood that the cutout can be done in a single step by an automatic process but the above description has been derived from the actual process used in the hand fabrication of this sheet. After the sheet has been cut at each corner as described, the lines YU and UM are brought together and stitched with a flat felled seam. Each corner as U and YM is reinforced with a zig-zag stitch. The edge MF is hemmed with a $\frac{1}{4}$" hem. If it is desired to use piping to provide a decorative edge, a rectangular $\frac{1}{4}$" seam is sewn on edges YUM before sewing them together. A piping can then be sewn over the edge from F to M over seam YUM across the width of the sheet to the other corner.

In this manner, the sheet above described is rapidly and easily fabricated. The configuration of the sheet shown can be manufactured by existing looms due to the fact that the sheet is of the same dimensions as conventional flat sheets now being provided. The sheet further results in a savings in manufacturing material due to the cutout sections as described.

Hence, by using modern production techniques, the manufacturer can determine the most optimum way to cut raw material in order to receive a considerable reduction in the amount of sheet material used. It is further seen that the sheet employs no elastic and therefore circumvents serious problems in both the manufacturing procedure and those problems associated with storage and laundering.

In regard to the example depicted, it is of course understood that the sheet can be fabricated to accomodate any mattress size. With the dimensions given above, when the sheet is used as a top sheet, it has an approximate 7" drawback flat hem at the top but can also serve as a fitted sheet at the bottom. It is therefore seen that the sheet allows one sheet to be used for each size bed and therefore one no longer requires two different type of sheets for the consumer, stores, institutions or mills. This results in a substantial reduction in inventory while providing a greater profit for all concerned. The sheet is much easier and quicker to use to make up a bed. If piping is used as described, both the top and bottom sheets present a most pleasing fashion appearance as depicted in the various drawings. The advantages of the sheet in practical use are quite numerous and the sheet therefore results in a substantial savings to the consumer, the retailer and the manufacturer.

It will be apparent that many changes and modifications of the several features described herein may be made without departing from the spirit and scope of the invention. For example, the unique bed cover as described above can be used as a blanket, a bed spread or any other type of covering which are presently used in conjunction with beds.

I claim:

1. An improved bed covering or sheet which can be employed as both a top or bottom sheet for a bed mattress, comprising:

a fabric box-like structure having an opened bottom surface and a closed planar top surface which is substantially the same length and width as said mattress, with two opposite sidewalls of said box-like structure having a width substantially equal to the thickness of said mattress, with the other two sidewalls having a first portion of the same width as the thickness of said mattress and with the edges of said first portion secured to adjacent edges of the other sidewalls to form said box-like structure and with a further trapezoidal portion depending from said other two sidewalls which edges of said trapezoidal portions are not sewn to any other edge of said sheet with the base of said trapezoidal portion integral with the outer edge of said associated first portion to enable a user to cover said mattress in a first mode where said structure is employed as bottom sheet and used in a second mode where said structure is drawn inside out to be employed as a top sheet and when employed as a top sheet said sheet can be folded back at the top edge to cover the top of a blanket to provide angular side panels on either side of said mattress due to said trapezoidal portions.

2. The bed covering or sheet according to claim 1, wherein said planar top surface is a rectangular surface having two opposite sides each of a length substantially equal to the width of said mattress and two longer opposite sides each of a length substantially equal to the length of said mattress, with the two opposite sidewalls indicative of the width being rectangular in shape and with the two longer sidewalls characterized by a rectangular first portion integrally formed with a trapezoidal further portion.

3. The bed covering or sheet according to claim 1, further including a decorative trim located along the edges formed by said planar top surface and at least two opposite sidewalls.

4. The bed covering or sheet according to claim 1, further including a decorative trim directed along the side edges of said trapezoidal portion.

5. A blank or pattern for a bed covering or sheet for use with a bed mattress, comprising:

a central planar section (11) having a length (A) and a width (B) substantially equal to the length and width of said bed mattress, with first (12) and second (13) planar panels depending from the top and bottom opposite edges of said planar section, with third (14) and fourth (15) planar portions depending from opposite side edges directed from top and bottom edges and with fifth (16) and sixth (17) trapezoidal portions extending from said third and fourth portions, with four corner right angles formed as the intersection between the side surfaces of each of the first and second planar panels associated with the respective side of one of said third and fourth planar portions, with the side edges of each panel forming said right angle joined together to form a box-like structure with extending trapezoidal portions, with the edges of said trapezoidal portions not secured to any edge, to enable said pattern to be used as a top or a a bottom sheet, and when used as a bottom sheet said box-like structure is emplaced over said mattress with said trapezoidal portions extending downwardly and when used as a top sheet said pattern is turned inside out with a top surface of said sheet folded back at the top edge to cover the top of a blanket to provide angular side panels on either side of said mattress due to said trapezoidal portions.

6. The blank or pattern according to claim 5, wherein said central planar member is rectangular in configuration, with said top and bottom opposite edges being substantially equal to the width of said mattress, and with said side edges being substantially equal to the length of said mattress, with said first and second planar panels being rectangular in configuration each of width substantially equal to the thickness of said mattress and with said third and fourth planar portions being rectangular in configuration and each of a width substantially equal to the thickness of said mattress.

7. The blank or pattern according to claim 5, wherein said trapezoidal portions have the non-parallel sides thereof directed at the same angle with the base of the trapezoidal being integral with the edge of the associated side edge of said central planar section.

8. The blank or pattern according to claim 7, further including a decorative trim located at least along the nonparallel sides of said trapezoidal portions.

9. The blank or pattern according to claim 5, further including a decorative trim located at least along the edges where said first and second planar panels meet with said central planar section.

* * * * *